United States Patent [19]

Troncone et al.

[11] Patent Number: 4,989,285

[45] Date of Patent: Feb. 5, 1991

[54] SECURITY BLANKET WITH TACTILE CHARACTERISTICS SIMULATIVE OF THE AMNION AND AMNIOTIC FLUID WITHIN THE SAME

[76] Inventors: Jeanelle N. Troncone; Gregory A. Troncone, both of 10839 Eldora Ave., Sunland, Calif. 91040

[21] Appl. No.: 367,988

[22] Filed: Jun. 19, 1989

[51] Int. Cl.[5] ..... A47G 9/02

[52] U.S. Cl. ..... 5/482; 5/486; 5/502

[58] Field of Search ..... 5/81 R, 81 C, 482, 486, 5/487, 500, 502, 485, 490; 446/267; 428/193, 212

[56] References Cited

U.S. PATENT DOCUMENTS

| | | | |
|---|---|---|---|
| 2,544,797 | 3/1951 | Lippmann | 5/502 |
| 3,829,914 | 8/1974 | Treat | 5/82 R X |
| 4,051,565 | 10/1977 | Berge | 5/431 X |
| 4,276,031 | 6/1981 | Lueck | 434/260 |
| 4,572,174 | 2/1986 | Eilender et al. | 5/485 X |

*Primary Examiner*—Michael F. Trettel

*Attorney, Agent, or Firm*—Beehler & Pavitt

[57] ABSTRACT

A security blanket which is simulative of the tactile response of the amnion lining and amniotic fluid as known and seen to be experienced by a fetus by the use of ultrasonography is provided by juxtapositioning two flexible sheets of material which are preferably attached only on their common peripheral boundaries. The sliding coefficient of friction between the two sheets is low and simulative of fluidic friction so that when the sheets are manipulated or stroked by the hand and fingers of an infant, a fluidic or smooth glide is sensed. The sheets preferably are formed as a rectangle 14 by 18 inches and are bound along their common peripheries by a border. In one embodiment the brush flannel sheet is attached to a charmeuse satin sheet and bound by satin border.

12 Claims, 1 Drawing Sheet

FIG. 1
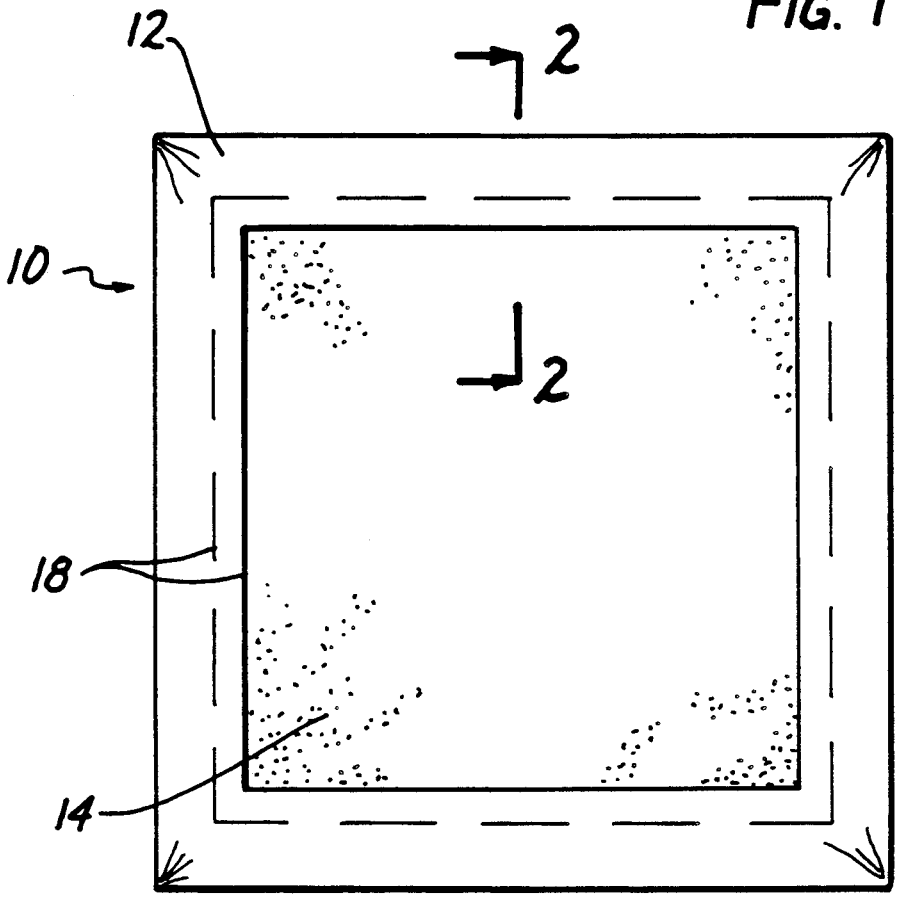
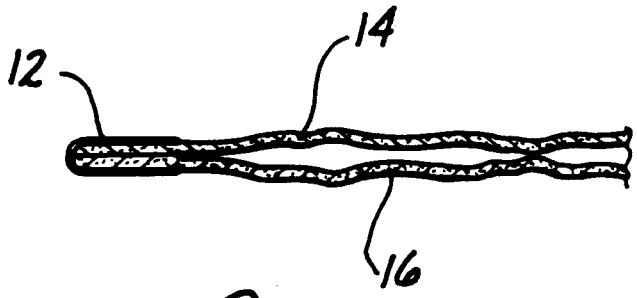
FIG. 2

SECURITY BLANKET WITH TACTILE CHARACTERISTICS SIMULATIVE OF THE AMNION AND AMNIOTIC FLUID WITHIN THE SAME

BACKGROUND OF THE INVENTION

1. Field of the Invention

The invention relates to apparatus for pacifying infants and, in particular, to a security blanket which is simulative of amnion (the lining of fetal membrane) and amniotic fluid within the amnion.

2. Description of the Prior Art

Newborn infant behavior is well known to include a sucking reaction from the time of birth. This behavior continues through infancy and the toddler years, even where not connected with feeding. The behavior appears to be a pacifying behavior and is often evidenced by thumb sucking, blanket sucking or through intentional use of a pacifier. It is argued by some that the behavior is so deeply ingrained in human nature that it is transmuted in adulthood to other forms.

In addition to the sucking behavior, the infant also evidences a clutching or stroking behavior as soon as his or her motor skills become sufficiently developed to grasp an object. This behavior is seen in infants and toddlers in their tendency to clutch and stroke soft objects such as blankets, teddy bears, and the like. The research of Dr. Passman of the University of Wisconsin concludes that the majority of infants and toddlers attach to (cuddle or stroke) a soft item, most often the satin edge of a crib blanket or their mother's nightie in an attempt to achieve the familiar feel and comfort of the sensations of the amnion lining and amniotic fluid. Again, this behavior appears to be so deeply ingrained into human nature that it arguably continues into adulthood, either in the same form which is exhibited during childhood, or becomes transmuted to other forms.

What is not readily appreciated is that these behaviors and others are exhibited by the fetus while in utero. Thumb sucking, for example, has been directly observed in utero and more recently, the stroking of the amnion lining and its amniotic fluid has been observed and is believed by some to be purposeful. The amnion lining and its fluid are of a silky, satiny consistency and feel.

Therefore, what is needed is a pacifying apparatus which can serve a basic human need of infant and toddlers. Fulfilling the inborn need for stroking comfort and simulating the familiar sensations within the secure womb environment, namely the amnion lining and amniotic fluid.

BRIEF SUMMARY OF THE INVENTION

The invention is an apparatus for providing pacification comprising a first sheet having a first type of tactile characteristic and a second sheet having a second type of tactile characteristic. The first and second sheets are selectively coupled together to allow slipping of the first and second sheets with respect to each other when manually manipulated by the infant.

As a result, the apparatus is tactilely simulative of amnion lining and amniotic fluid.

In the preferred embodiment, the first sheet is flannel or more particularly brushed flannel. The second sheet is satin or more particularly charmeuse satin.

The first and second sheet are connected together only at their common peripheral boundaries.

The apparatus further comprises a boundary layer substantially circumscribing the common peripheral edges of the first and second sheets. The boundary layer has a predetermined tactile characteristic. The first tactile characteristic is distinct from the second tactile characteristic, but sliding friction between the first and second sheets low is on account of the first and second tactile characteristics of the sheets.

The first and second sheets can be pressed together and slid with respect to each other by manual manipulation with a co-efficient of sliding friction therebetween to simulate the sliding of two flexible layers with an interlying liquid layer. The first and second sheets are generally rectangular with dimensions of 18 inches by 14 inches or less.

The invention is still further characterized as a security blanket for use by an infant for pacification and comfort comprising a first element for providing a first tactile characteristic, and a second element coupled to the first element for providing a second tactile characteristic. The first and second element are manually disposable in frictional sliding engagement with each other by the infant. The first and second element have a relative co-efficient of sliding friction with respect to each other simulative of fluidic friction.

As a result, a security blanket having a tactile feel suggestive of the silky amnion lining and slippery amniotic fluid is provided.

BRIEF DESCRIPTION OF THE DRAWINGS

FIG. 1 is a plan view of the security blanket incorporating the invention as would be seen when the blanket is laid out flatly and viewed from above.

FIG. 2 is a cross-sectional view taken through lines 2—2 of FIG. 1.

DETAILED DESCRIPTION OF THE PREFERRED EMBODIMENT

A security blanket which is simulative of the tactile response of amnion lining and amniotic fluid as seen to be experienced by a fetus by use of sonography is provided by juxtapositioning two flexible sheets of material which are preferably attached only on their common peripheral boundaries. The sliding co-efficient of friction between the two sheets is low and simulative of fluidic friction so that when the sheets are manipulated by the hand or fingers of an infant, a fluidic or smooth glide is sensed. The sheets preferably are formed as a rectangle 14 by 18 inches and are bound along their common peripheries by a border. In one embodiment, a brush flannel sheet is attached to a percale satin sheet and bound by a satin border.

FIG. 1 shows in plan view one surface of the security blanket generally denoted by reference numeral 10. The security blanket of the illustrated embodiment is generally square or rectangular and preferably is 14 by 18 inches in planar dimension. Materially larger sizes causes the satin to bag or hang away from the flannel thereby detracting from the desired effect. The bagging can be avoided by quilting or stitching, but only at a loss of the tactile fluidic sensation. It must be understood that other dimensions or shapes for blanket 10 could be utilized if within the teachings of the specification without departing from the spirit and scope of the invention.

However, the size of the preferred embodiment has been chosen with the purpose to provide a blanket capable of being easily manipulated by the infant or toddler given normal motor skills of his or her age. No attempt is made to provide a blanket 10 having a size adequate to cover or provide warmth to the body of the infant or toddler or any other type of protection. In fact, a smaller than body size is preferred to avoid tangling of blanket 10 about the toddler's extremities, body or neck or adjacent baby furniture, such as the rungs within a playpen or crib.

Blanket 10, as illustrated in FIG. 1, is comprised of a border 12 of one inch in width which is preferably sewn to the body of blanket 10 and which completely circumscribes the edge of blanket 10. Border 12 is made of brushed satin in a contrasting color to the remaining portions of the blanket.

Border 12 is better depicted in the cross sectional view of FIG. 2 which is taken through lines 2—2 of FIG. 1. In FIG. 2, it is clearly illustrated that border 12 is folded or bent across the edge of blanket 10, thereby providing a smooth, soft and virtually edgeless perimeter for blanket 10.

A first side of blanket 10 is comprised of a first sheet of material 14 as shown in the plan view of FIG. 1 and in cross sectional view in FIG. 2. Sheet 14 in the preferred embodiment is comprised of a soft brushed flannel. Sheet 14 is substantially co-extensive with the planar extent of blanket 10 and provides a broad tactile area.

On the opposing side of blanket 10, on that side opposite sheet 14 and the opposing side as shown in FIG. 1, a second sheet 16 is provided and is depicted in the cross sectional view of FIG. 2. Sheet 16 is made of a material with contrasting tactile characteristics to those of sheet 14. In the illustrated embodiment, sheet 16 is made of charmeuse satin. Preferably, sheet 16 has a contrasting color as well as tactile characteristics from sheet 14, border 12 or both.

As illustrated in FIG. 2, sheets 14 and 16 are attached at or near their outside edges. In the preferred embodiment, attachment of sheets 14 and 16 occur only along the perimeter edge. Again, in the illustrated embodiment, attachment of sheets 14 and 16 along their common perimeter edges, are by means of the stitching through which border 12, in turn, is attached to sheets 14 and 16. In the illustrated embodiment, border 12 is folded and sewn on the perimeter edge of blanket 10 with a straight type stitch entirely through both opposing side of border 14 and sheets 14 and 16.

It should be particularly noted that in the illustrated embodiment the remaining portion of sheets 14 and 16 are unattached or substantially unattached. This allows sheets 14 and 16 to be moved with respect to each other. The inner surface of sheet 16 is smooth and almost glassy to the touch. Therefore, when sheets 14 and 16 are squeezed together as between the thumb and fingers of an infant's or toddler's hand, they can be pressed together and slipped back and forth with respect to each other with a gliding or liquid feel. This stroking is an inborn comfort response.

This is in fact the behavior which is observed of infants or toddlers who grasp the blanket and manipulate or stroke it with their hand or between their fingers or some other means, to work or rub the blanket layers 14 and 16 against each other.

The manual manipulation practiced by the infant or toddler appears to be similar to stroking the amnion lining or the manual manipulation of the amniotic fluid by fetuses which is often observed through sonography. It is believed and it is the intended purpose of blanket 10 to provide a structure and selection of materials, which is similar or at least evocative of the amnion lining and amniotic fluid both in feel and manipulability. It is thus believed that the infant or toddler is thereby allowed to continue a strong and deep human behavior which provides a deeper and more sure sense of security and comfort. The infant or toddler receives a sense of comfort as it strokes the fabric, simulating the familiar sensations of the secure womb environment.

It must be understood that many alterations and modifications may be made by those having ordinary skill in the art without departing from the spirit and scope of the invention. Therefore, the choice of materials and their attachment, as well as the places of their attachment have been shown only for the purposes of example. It is entirely consistent with the scope of the present invention that other types of materials which will have the same or equivalent tactile or manipulative characteristics, or other means of attaching the components of the blanket together could be chosen. Therefore, the illustrated embodiment is set forth only for the purposes of example and should not be taken as limiting the invention defined by the following claims which extend to the claimed elements and all equivalent means or steps.

I claim:

1. An apparatus for providing pacification to an infant by tactile simulation of an amniotic environment comprising:

a first textile sheet having a first type of tactile characteristic and having a peripheral boundary;

a second textile sheet having a second type of tactile characteristic and having a peripheral boundary, said first and second sheets selectively coupled together to allow slipping of said first and second sheets with respect to each other when manually manipulated by said infant, so that said apparatus is tactilely simulative of said amniotic environment, wherein said first and second sheets, have a common peripheral boundary and are connected together only at their common peripheral boundaries.

2. The apparatus of claim 1 wherein said first tactile characteristic is distinct from said second tactile characteristic, but wherein sliding friction between said first and second sheets is low on account of said first and second tactile characteristics of said sheets.

3. The apparatus of claim 2 wherein said first and second sheets can be pressed together and slid with respect to each other by manual manipulation with a co-efficient of sliding friction therebetween to simulate the sliding of two flexible layers with an interlying liquid layer.

4. The apparatus of claim 1 wherein said first and second sheet can be pressed together and slid with respect to each other by manual manipulation with a co-efficient of sliding friction therebetween to simulate the sliding of two flexible layers with an interlying liquid layer.

5. The apparatus of claim 1 used in combination with infant furniture wherein said first and second sheets are generally rectangular with dimensions of 14 inches by 18 inches or less to avoid entanglement with said infant and infant furniture.

6. An apparatus for providing pacification by tactile simulation of an amniotic environment comprising:

a first textile sheet having a first type of tactile characteristic and having a peripheral boundary;

a second textile sheet having a second type of tactile characteristic and having a peripheral boundary, said first and second sheets selectively coupled together to allow slipping of said first and second sheets with respect to each other when manually manipulated by said infant, so that said apparatus is tactilely simulative of said amniotic environment, wherein said second sheet is satin and wherein said first sheet is flannel, and wherein said first and second sheets have a common peripheral boundary and are connected together only at their common peripheral boundaries.

7. An apparatus for providing pacification by tactile simulation of an amniotic environment comprising:

a first textile sheet having a first type of tactile characteristic and having a peripheral boundary;

a second textile sheet having a second type of tactile characteristic and having a peripheral boundary, said first and second sheets selectively coupled together to allow slipping of said first and second sheets with respect to each other when manually manipulated by said infant, so that said apparatus is tactilely simulative of said amniotic environment, wherein said second sheet is satin and wherein said first sheet is flannel, wherein said second sheet is satin and wherein said first sheet is flannel brushed on both sides, and wherein said first and second sheets have a common peripheral boundary and are connected together only at their common peripheral boundaries.

8. An apparatus for providing pacification by tactile simulation of an amniotic environment comprising:

a first textile sheet having a first type of tactile characteristic and having a peripheral boundary;

a second textile sheet having a second type of tactile characteristic and having a peripheral boundary, said first and second sheets selectively coupled together to allow slipping of said first and second sheets with respect to each other when manually manipulated by said infant, so that said apparatus is tactilely simulative of said amniotic environment, wherein said second sheet is satin and wherein said first sheet is flannel, and further comprising a common peripheral boundary of said first and second sheets, and boundary layer substantially circumscribing said common peripheral edges of said first and second sheets, said boundary layer having a predetermined tactile characteristic.

9. An apparatus for providing pacification by tactile simulation of an amniotic environment comprising:

a first textile sheet having a first type of tactile characteristic and having a peripheral boundary;

a second textile sheet having a second type of tactile characteristic and having a peripheral boundary, said first and second sheets selectively coupled together to allow slipping of said first and second sheets with respect to each other when manually manipulated by said infant, so that said apparatus is tactilely simulative of said amniotic environment;

wherein said second sheet is satin and wherein said first sheet is flannel, and further comprising a common peripheral boundary of said first and second sheets, and a textile boundary layer substantially circumscribing said common peripheral edges of said first and second sheets, said boundary layer having a predetermined tactile characteristic.

10. The apparatus of claim 9 wherein said first tactile characteristic is distinct from said second tactile characteristic, but wherein sliding friction between said first and second sheets is low on account of said corresponding first and second tactile characteristics of said sheets.

11. The apparatus of claim 10 wherein said first and second sheets are generally rectangular with dimensions of 14 inches by 18 inches or less.

12. A security blanket for use by an infant for pacification and comfort comprising:

first means for providing a first tactile characteristic;

second means coupled to said first means for providing a second tactile characteristic, said first and second means being manually disposable in frictional sliding engagement with each other by said infant, said first and second means having a relative co-efficient of sliding friction with respect to each other simulative of fluidic friction;

wherein said first means is comprised of a sheet of brushed flannel and said second means is comprised of a sheet of charmeuse satin, said first and second means having a common outer periphery, said first and second sheets being bound together only at said outer common periphery, whereby a security blanket having a tactile feel suggestive of amnion lining and amniotic fluid is provided.

* * * * *